US005421395A

United States Patent [19]

Horn

[11] Patent Number: 5,421,395

[45] Date of Patent: Jun. 6, 1995

[54] SWINGING-AND-SLIDING DOOR FOR VEHICLES, ESPECIALLY MASS-TRANSIT VEHICLES

[75] Inventor: Manfred Horn, Kaufungen, Germany

[73] Assignee: Firma Gebr. Bode & Co. GmbH, Kassel, Germany

[21] Appl. No.: 120,106

[22] Filed: Sep. 10, 1993

[30] Foreign Application Priority Data

Sep. 16, 1992 [DE] Germany ..... 42 30 867.4

[51] Int. Cl.[6] ..... A47H 33/00

[52] U.S. Cl. ..... 160/405; 160/DIG. 8; 49/209; 49/221

[58] Field of Search ..... 160/405, 354, DIG. 8, 160/40, 188, 189, 201, 209; 49/209, 210, 221

[56] References Cited

U.S. PATENT DOCUMENTS

| | | | |
|---|---|---|---|
| 2,552,356 | 5/1951 | Weigele | 49/210 |
| 3,903,648 | 9/1975 | Maneck | 49/221 X |
| 3,994,094 | 11/1976 | Marzocco | 49/221 X |
| 4,157,846 | 6/1979 | Whitcroft | 49/209 X |
| 4,495,729 | 1/1985 | Britzke et al. | 49/221 X |
| 4,869,544 | 9/1989 | Anwyll et al. | 49/209 X |
| 4,932,715 | 6/1990 | Kramer . | |

FOREIGN PATENT DOCUMENTS

| | | |
|---|---|---|
| 196448 | 10/1986 | European Pat. Off. . |
| 3419338 | 11/1985 | Germany . |

*Primary Examiner*—David M. Purol

*Attorney, Agent, or Firm*—Sprung Horn Kramer & Woods

[57] ABSTRACT

A swinging-and-sliding door for vehicles which opens in two mutually perpendicular steps, a first step wherein it bends out of a doorway-closed position and into a ready-to-slide position and a second step wherein it slides aside horizontally into a doorway-open position. The door is mounted with a roller carriage and a horizontal track fastened to the inside of the door essentially halfway up. The roller carriage is mounted in a doorway immediately adjacent to a vertical edge of a doorframe opposite to the leading edge of the door in the closed position and on the same level as the track. The roller carriage travels back and forth in the track and in and out in the same direction as the first door-opening step on a carriage holder. The door is at least to some extent flexible in the direction it moves in during the first door-opening step and is subjected to tension such that the middle of the door will resiliently bend to a prescribed extent in a direction opposite that of the first door-opening step.

8 Claims, 3 Drawing Sheets

SWINGING-AND-SLIDING DOOR FOR VEHICLES, ESPECIALLY MASS-TRANSIT VEHICLES

BACKGROUND OF THE INVENTION

The present invention concerns a swinging-and-sliding door for vehicles, especially mass-transit vehicles. A doorframe is mounted in an aperture in the side wall of the vehicle's body. Insulation extends around the edge of the door. The door opens in two mutually perpendicular steps. In the first step it swings out of the doorway-closed position and into a ready-to-slide position and in the second step it slides aside horizontally into a doorway-open position.

A swinging-and-sliding door of this genus is known from European Patent 196 488 B1 for instance. It is suspended at the upper edge and travels on tracks at the top and bottom. The suspension mechanism includes an overhead track extending in the direction the door slides in. The overhead track extends essentially over the total width of the doorway. The door is suspended from the track by, and slides along the track on, a hanger. The suspension mechanism swings out on levers during the first door-opening step and slides back along the outside of the body and into the doorway-open position during the second door-opening step. The mechanisms involved in suspending and maneuvering this door are relatively complicated.

German Patent 3 419 338 C2 and U.S. Pat. 4,932,715 describe exterior-mounted sliding doors for vehicles, motor vehicles for example. An arm is articulated halfway up the door or between halfway up and the bottom edge. A roller carriage is mounted on the arm. The roller carriage travels inside a track on the exterior of the body. Other tracks may be present as well. The track or tracks are designed to maneuver the door out of the doorway in one door-opening step and to one side in another door-opening step that is to some extent simultaneous with the first step. These designs are also relatively complicated approaches to maneuvering the door. Furthermore, it is difficult to reliably insulate the door all around its edge.

SUMMARY OF THE INVENTION

The object of the present invention is to provide simple means of generating the two steps involved in maneuvering a swinging-and-sliding door of the aforesaid genus that will also allow the door to be reliably secured and insulated.

This object is attained in accordance with the invention by a roller carriage and a track. The track is horizontal and fastened to the inside of the door essentially halfway up. The roller carriage is mounted in the doorway, immediately adjacent to the leading edge of the opening door and on the same level as the track. The roller carriage travels back and forth in the track. The roller carriage travels in and out in the same direction as the first door-opening step on a carriage holder fastened to the body. The door is at least to some extent flexible in the direction it moves in during the first door-opening step and is subjected to tension such that when the door is positioned with its insulated edge tight against the edge of the doorway, the middle of the door will resiliently bend to a prescribed extent in a direction opposite that of the first door-opening step.

The door in accordance with the invention can, as specified hereinafter, swing out. In this event the first door-opening step is outward and the tension on the opening door forces its edges in around the middle.

The door in accordance with the invention can alternatively swing in. In this event the first door-opening step is inward and the tension on the opening door forces its edges out around the middle.

Advantageous advanced versions of the invention are specified hereinafter.

Basically, the door in accordance with the invention constitutes a "lid" that rests against the doorframe and is lifted off and displaced to one side. The lid is articulated and maneuvered essentially only halfway up in accordance with a roller carriage that travels back and forth in a track. To keep the doorway essentially unobstructed, the roller carriage travels back and forth in the direction of the first door-opening step on a carriage holder at one side and in the vicinity of the doorframe. The track and articulation need not be exactly halfway up the door. They can be slightly above or below that level. The tension on the door that constitutes another characteristic of the invention will in any event ensure a tight fit between the closed door and the doorway.

The door in accordance with the invention is extremely simple. There is no need to manufacture one version to be employed as a swing-out door and a mirror-symmetrical version as a swing-in door. The same design can be employed for both, bending in or out depending on what side of the doorframe the carriage holder is mounted on. It is particularly practical to fasten the carriage holder to one of the jambs in the doorframe, although it is of course also possible to fasten it to an upright connected to the wall of the body.

Both steps in opening the door can be produced by electric motors for example. In this event it will be particularly simple for the motor that produces the second step, the sliding motion, that is, to be a proximity induction motor.

One embodiment of a swinging-and-sliding door in accordance with the invention will now be specified with reference to the drawing, wherein

DETAILED DESCRIPTION OF THE INVENTION

Figure 1:
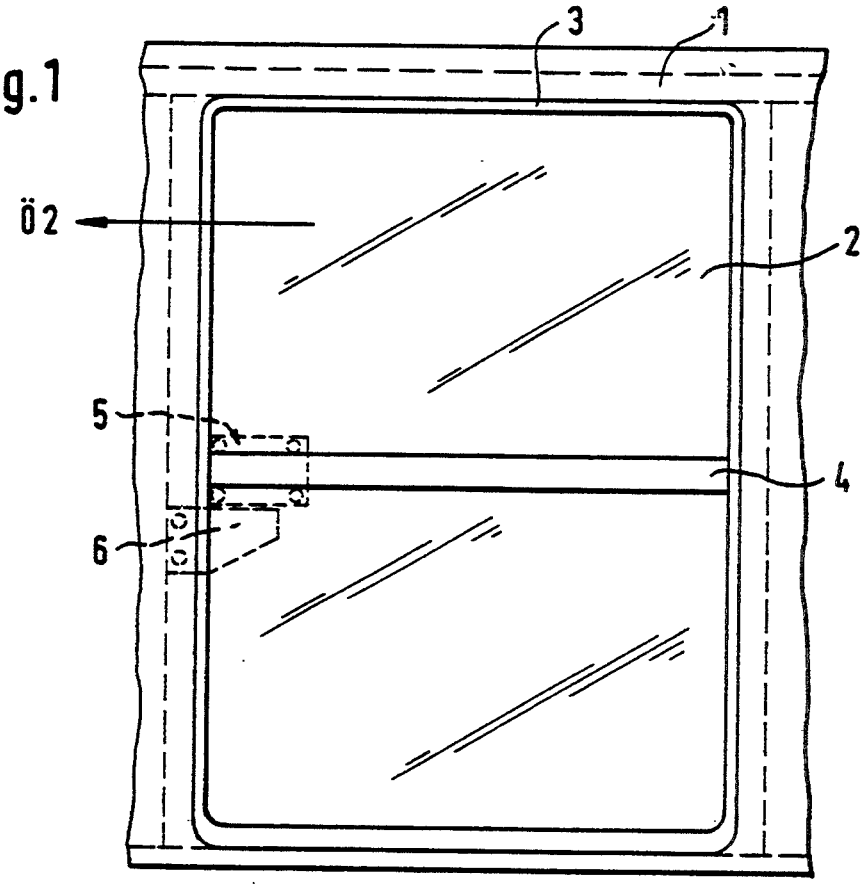
FIG. 1 is a highly schematic view of a swinging-and-sliding door from outside.
Figure 2:
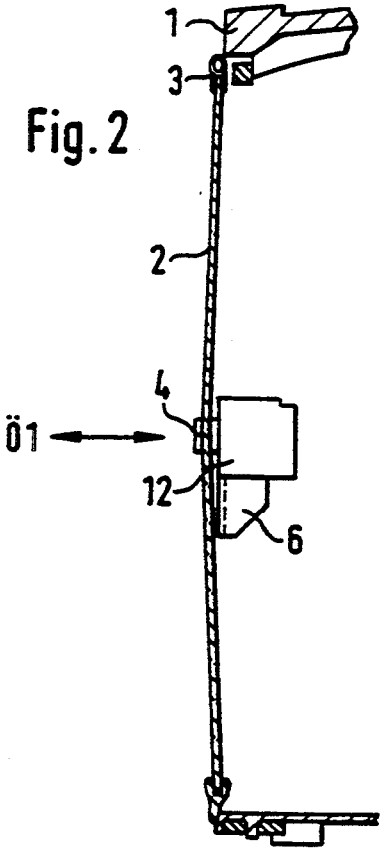
FIG. 2 is a vertical section through the same door closed.
Figure 3:
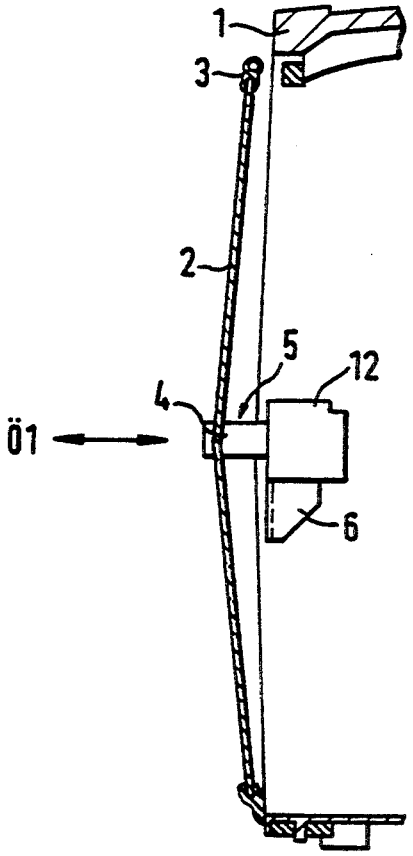
FIG. 3 is a vertical section through the same door open.

The swinging-and-sliding door 2 illustrated in the drawing can be accommodated in an unillustrated way against a doorframe 1 in an aperture in the side wall of a bus for example. A strip of insulation 3 extends around the edge of the door. Approximately halfway up the inside of the door is a horizontal track 4. A roller carriage 5, illustrate highly schematically in FIGS. 1 through 3, engages track 4. Roller carriage 5 is accommodated in the housing 12 illustrated in FIGS. 2 and 3 and travels in and out on a carriage holder 6 fastened to one of the jambs, the one on the left in FIG. 1 for example, of doorframe 1. The illustrated door 2 swings out. FIGS. 1 through 3 illustrate how it opens. It initially swings out in direction $\ddot{01}$ and then slides aside in direction $\ddot{02}$ along the outside of the vehicle's wall. It closes in the opposite sequence.

Figure 4:
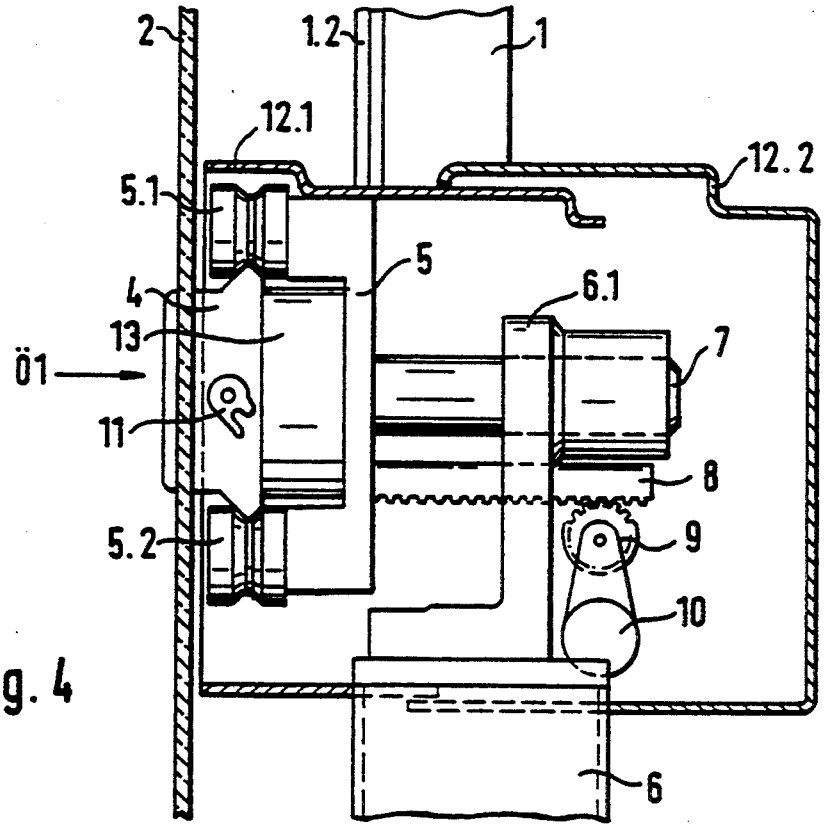
FIG. 4 is a much larger-scale vertical section through the carriage holder and roller carriage with the door open.
Figure 5:
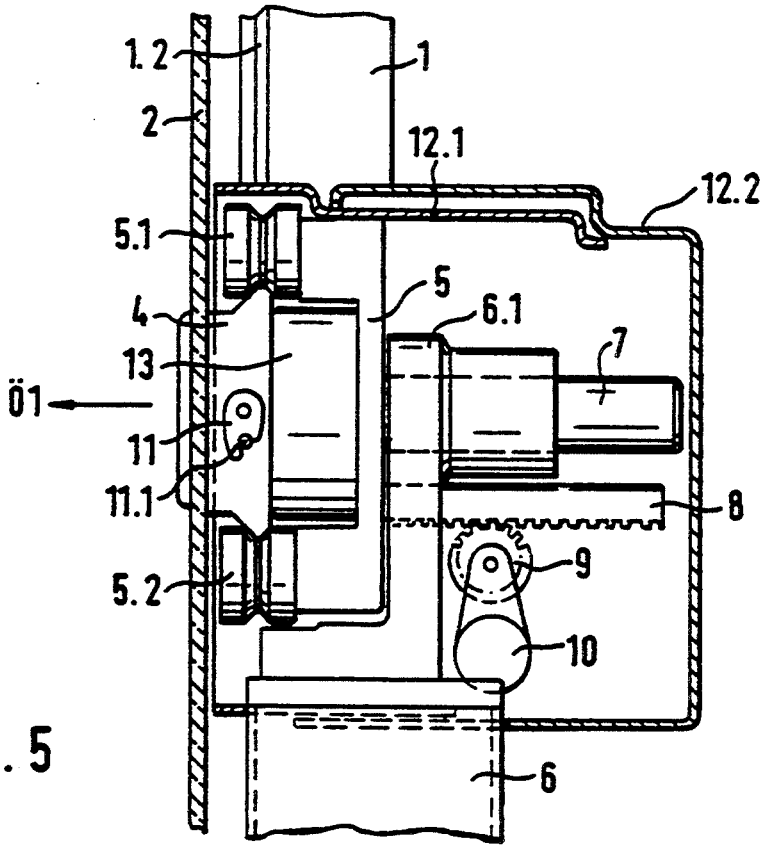
FIG. 5 is a same-scale vertical section through the carriage holder and roller carriage with the door closed.

FIGS. 4 and 5 illustrate roller carriage 5 and carriage holder 6 in detail. Pairs 5.1 and 5.2 of rollers engage the top and bottom of track 4, which is fastened to the inside of door 2. The rollers are attached to a roller carriage 5 in the form of a length of U-shaped structural section. Roller carriage 5 is mounted on a pair of horizontally adjacent bars 7, only one of which is visible in FIGS. 4 and 5, in a component 6.1 in the form of a length of L-shaped structurally section. Component 6.1 is fastened to Carriage holder 6. The first door-opening step, in direction $\ddot{01}$, is governed by an electric motor 10 that drives a cogwheel 9. Cogwheel 9 in turn drives a pinion 8 fastened to roller carriage 5.

The second door-opening step, in direction $\ddot{02}$, is governed by a proximity induction motor 13. Induction motor 13 is accommodated opposite track 4 and inside roller carriage 5, which it drives directly.

At one end of track 4 is a pawl 11 that, as long as the door 2 remains closed, is held by gravity against a stop 11.1 on doorframe 1. A similar pawl can be positioned at the other end of the track, hidden in FIGS. 4 and 5. The two pawls can be connected by a rod to ensure that they force the closed door tight against the doorframe.

Roller carriage 5 and its drive mechanisms are as will be evident from FIGS. 4 and 5 accommodated inside a two-component housing. Component 12.1 follows door 2 and roller carriage 5 and component 12.2 is fastened to carriage holder 6.

Since flexible door 2 is as will be evident from FIGS. 2 and 3 subject to tension, the edges of the open door are forced in around its middle and toward doorframe 1 as illustrated in FIG. 3. When the door closes, drive mechanism including elements 8, 9, and 10 force its edges in opposition to its resilience against the edges of doorframe 1. The result is a tight seal all around, and there will be no clattering of unsecured areas.

When the door swings inward as it opens, in an embodiment that is not illustrated herein, the closed door will rest against the inner edge of the doorframe and the tension will be in the opposite direction.

Figure 6:
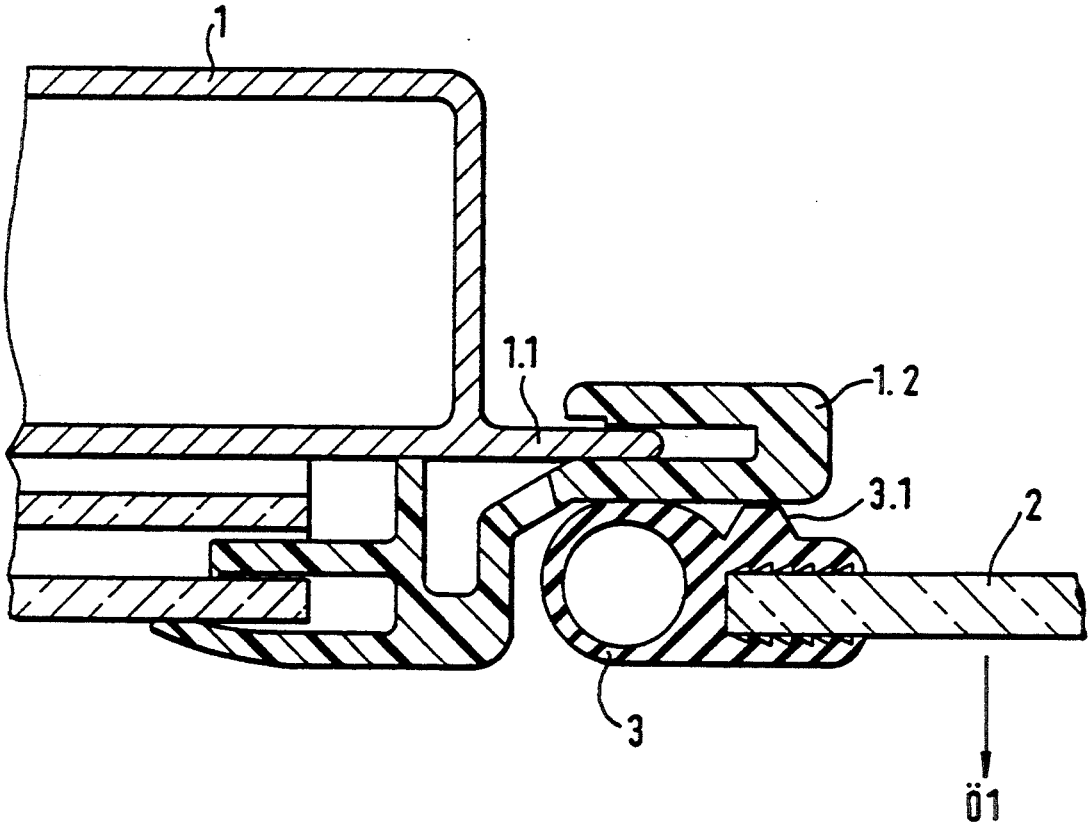
FIG. 6 is large-scale horizontal section through one edge of the door and the adjacent edge of the doorframe.

As will be evident from FIG. 6, insulation 3 is a length of hollow structural section with a ridge 3.1 that extends around its inward-facing surface along the edge of door 2. The ridge rests tight against a trim 1.2 that accommodates a flange 1.1 around the edge of the doorframe 1.

As will be evident from FIG. 6, insulation 3 will come to rest with its hollow channel against the facing surface of trim 1.2 as the door closes, and ridge 3.1 will prevent the door from traveling too far.

What is claimed is:

1. A door assembly for a vehicle having a doorframe in a body, comprising: a door having insulation therearound; means mounting the door for movement between a closed position wherein the door is in the door frame and an open position in two mutually perpendicular steps including a first step in which the door is displaced from the closed position and into a sliding position and a second step in which the door is horizontally slidable into the open position, the means comprising a roller carriage and a track, means fastening the track is horizontally to an inside surface of the door intermediate of a top and bottom thereof, means mounting the roller carriage on the door adjacent to a vertical edge of the door frame opposite a leading edge of the door in the closed position and on the same level as the track for movement back and forth in the track and a carriage holder fastened to the body for mounting the roller carriage for movement in and out in the same direction as the door in the first step, and wherein the door is at least to some extent flexible in the direction it moves in during the first step and means for subjecting the door to tension such that when the door is positioned with its insulated edge tight against edges of the doorframe, the middle of the door will resiliently bend in a direction opposite that of the first step.

2. The door assembly as in claim 1, wherein the direction of first step is outward and the tension on the opening door forces its edges inward around the middle.

3. The door assembly as in claim 1, wherein the direction of the first step is inward and the tension on the opening door forces its edges outward around the middle.

4. The door assembly as in claim 1, wherein the doorframe has jambs and the carriage holder is fastened to one of the jambs.

5. The door assembly as in claim 1, further comprising means for driving the door during the first step including a rack, a pinion and an electric motor on the carriage holder that moves the roller carriage over the carriage holder in the direction of the first step.

6. The door assembly as in claim 1, further comprising means for driving the door during the second step including a proximity induction motor mounted on the roller carriage and driving the track directly.

7. The door assembly as in claim 1, wherein the insulation around the door is a length of hollow structural section with a ridge that extends around its inward-facing surface along edges of the door and rests tight against a trim that accommodates a flange around the edge of the doorframe when the door is in the closed position.

8. The door assembly as in claim 1, further comprising a first pawl at at least one end of the track a stop on the doorframe which is engaged by the first pawl when the door is in the closed position.

* * * * *